US005690352A

United States Patent [19]

Freisinger et al.

[11] Patent Number: 5,690,352

[45] Date of Patent: Nov. 25, 1997

[54] SNOWBOARD BINDING

[75] Inventors: Henry Freisinger; Johann Zotter, both of Vienna, Austria

[73] Assignee: HTM Sport- und Freizeitgeraete Aktiengesellschaft, Schwechat, Austria

[21] Appl. No.: 595,745

[22] Filed: Feb. 2, 1996

[30] Foreign Application Priority Data

Feb. 2, 1995 [AT] Austria ..... 181/95

[51] Int. Cl.[6] ..... A63C 9/084

[52] U.S. Cl. ..... 280/632; 280/14.2; 280/613; 280/627; 280/636

[58] Field of Search ..... 280/14.2, 607, 280/617, 627, 631, 632, 634, 636, 623, 613

[56] References Cited

U.S. PATENT DOCUMENTS

| | | | |
|---|---|---|---|
| 3,989,273 | 11/1976 | Schmidt | 280/631 |
| 4,214,773 | 7/1980 | Wittman | 280/631 |
| 4,607,859 | 8/1986 | Wittman et al. | 280/632 |
| 4,915,407 | 4/1990 | Brischoux | 280/626 |
| 5,044,654 | 9/1991 | Meyer | 280/613 |
| 5,056,809 | 10/1991 | Brischoux et al. | 280/617 |

FOREIGN PATENT DOCUMENTS 41 06 401 9/1992 Germany .

*Primary Examiner*—Richard M. Camby
*Assistant Examiner*—Avraham Lerner
*Attorney, Agent, or Firm*—Flynn, Thiel, Boutell & Tanis, P.C.

[57] ABSTRACT

The invention relates to a snowboard binding having two retaining brackets (6, 106) which are pivotably mounted on a base plate (2) or on parts (5, 105) displaceable longitudinally on the base plate (2), and which, when the binding is performing a retaining function, engage over the front and the rear sole borders of a boot (102), the binding being closed automatically when the boot (102) is inserted. The aim of the invention is to keep the friction between the boot (102) and the binding, and therefore the boot-insertion force to be applied, relatively low and, by means of an advantageous configuration of a locking system (10), to ensure a high securing force. This is achieved according to the invention in that an actuating element (11) is acted upon by a step-on element (7) which can be pivoted on a basic body (5) about a second axis (19), and in that a locking slide (8) is arranged in the base member (5), which locking body bears on the actuating element (11) and, after overcoming a dead center position, latches the actuating element (11).

17 Claims, 4 Drawing Sheets

SNOWBOARD BINDING

FIELD OF THE INVENTION

The invention relates to a snowboard binding that allows pivoting while releasably locking a boot to a snowboard.

BACKGROUND OF THE INVENTION

In the case of a known snowboard binding, as is disclosed in DE-OS 41 06 401, the pivot bracket engaging over the front sole border is articulated on a sliding part guided in a longitudinally displaceable manner on a retaining rail. The pivot bracket engaging over the rear sole border is pivotably articulated on a step-on element. Said step-on element is articulated on a sliding part fitted in a longitudinally displaceable manner on the retaining rail about a pivot pin located transversely with respect to said retaining rail. Arranged on the retaining rail is part of the locking mechanism into which a further part, provided on the step-on element, of the locking mechanism engages. When the boot is inserted into the binding, first of all the toe of the boot is fitted, with its front sole border, into the front pivot bracket, and then the step-on element is pivoted, by means of the sole of the boot, in the direction of the upper side of the snowboard until the two parts of the locking mechanism come into engagement with one another.

During the pivoting, the step-on element slides on the sole of the boot, which, in the case of VIBRAM soles having pronounced profiles and are used for snowboard boots, is possible only with increased outlay in terms of force or, in extreme cases, is not possible at all. A further disadvantage of this snowboard binding lies in the configuration of the locking mechanism. When using a snowboard, it is necessary, in certain situations, to remove a boot from the binding and to place the boot in the snow, beside the snowboard. During this process, snow or ice adheres to the sole of the boot and it is only possible to insert the boot back into the snowboard binding once the sole of the boot has been carefully cleaned.

In the case of a further commercially available snowboard binding, the retaining bracket which engages over the front sole border is pivotably articulated on a basic body. Said basic body may, for its part, be screwed fixedly in various positions on a base plate. The retaining bracket which engages over the rear sole border is articulated on two plates which, for their part, are pivotably mounted on a basic body, which may likewise be screwed fixedly in various positions on the base plate. The pin connecting the two plates is configured as a crankshaft. A rod which is acted upon by a spring and is mounted in the basic body engages on said pin and, together with a section of the crankshaft, forms a toggle lever, which constitutes the first part of a two-part latching system. The second part of the latching system is also arranged in said basic body. When the boot is inserted into the snowboard binding, a tread plate, which is mounted such that it can be pivoted about a separate pin, is pivoted in the direction of the upper side of the snowboard, and the two parts of the latching system are actuated at the same time. The toggle lever is forced over the dead center and, by the force of the spring, is pivoted further into its retaining position and retained there. The arrangement of the latching systems has a disadvantageous effect on this binding. A sufficiently large securing force cannot be achieved with this system. This is because, when a layer of snow has collected on the boot, the toggle lever cannot pivot into its maximum retaining position and full closure of the binding is no longer possible. The vertical loading which occurs during skiing reduces the securing forces further and the boot executes an undesired vertical pumping movement.

SUMMARY OF THE INVENTION

The object of the present invention is to eliminate the above-mentioned disadvantages and to provide a snowboard binding which, in the case of comparatively low boot-insertion forces being applied, ensures a high securing force for the boot.

This object is achieved according to the invention by the configuration of the snowboard binding in accordance with the defining part of claim 1.

When the boot is inserted into the binding, the step-on element and actuating element are pivoted in the direction of the upper side of the snowboard. Since the step-on element bears on the actuating element in the boot-insertion phase and, as the boot is inserted, the step-on element moves in a rolling manner on two inwardly oriented protrusions which are arranged on the plates and belong to the actuating element, said step-on element moving the actuating element into a latching position by means of a locking slide, it is the case that, when the boot is inserted into the binding, the friction between boot and binding, and therefore the boot-insertion force to be applied, are kept relatively low and, by means of the interaction of locking slide and actuating element, a high securing force is ensured.

A further configuration ensures as compact a construction of the snowboard binding as possible. A particularly favorable configuration of the snowboard binding is defined by modifying the arrangement of the first pivot pin and the second pin.

The features of another embodiment achieve an optimum relationship between the boot-insertion force and securing force and straightforward opening of the binding.

Further features permit a space-saving construction of the binding.

Further features make it possible to arrange the locking system beneath the boot, this being advantageous in design terms.

A further embodiment provides elasticity with the insertion of the boot and compensation for a layer of snow. Another configuration prevents undesired excessive turning of the actuating element.

BRIEF DESCRIPTION OF THE DRAWINGS

An advantageous embodiment of the snowboard binding according to the invention is represented in the drawings, in which:

FIGS. 4, 5 and 6 each show, likewise on an enlarged scale, a vertical longitudinal center section through the heel part of the snowboard binding according to the invention, wherein FIG. 4 shows the binding in a position ready for boot insertion, FIG. 5 shows the binding when the dead center has been reached, and FIG. 6 shows the binding in the closed position with a layer of snow on the sole of the boot.

DETAILED DESCRIPTION

Figure 1:
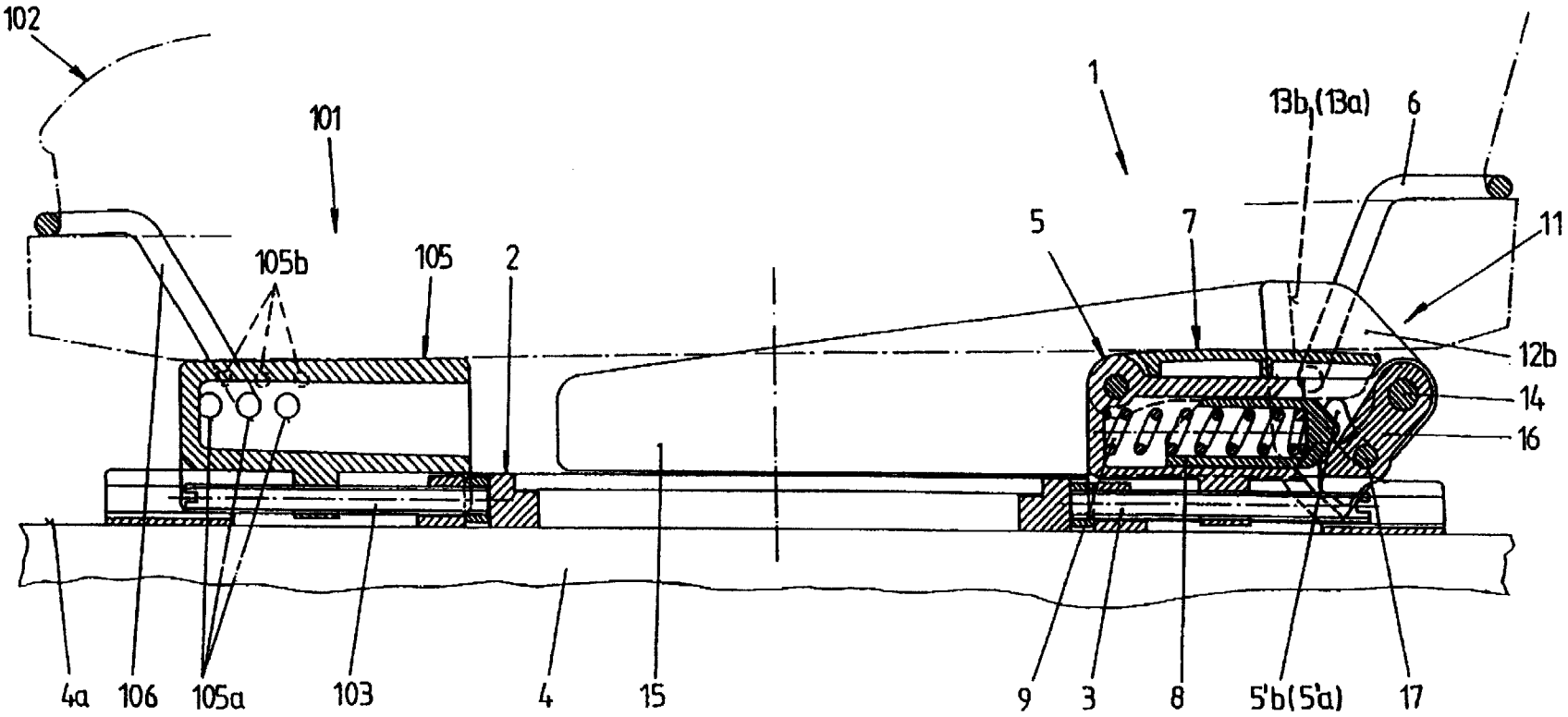
FIG. 1 shows a vertical longitudinal center cross-section through a complete binding in the closed position.

In FIG. 1, the toe part 101 and heel part 1 of a snowboard binding, also called a below binding, are guided in a longitudinally displaceable manner on a base plate 2 by means of two spindles 3, 103. The base plate 2 itself is fastened on the upper side 4a of a snowboard 4 by suitable fastening means (not shown), preferably by screws. The method of longitudinal adjustment is previously known and hence does not constitute the subject matter of the invention and thus is not described in any more detail.

The toe part 101, has a basic body 105 and a retaining bracket 106 which is pivotably mounted in said basic body 105 and, when a ski boot or snowboard boot 102, which is only schematically indicated in some of the figures, is inserted, engages over the front sole border of said boot 102 in a known manner. For the purpose of length adaptation, the retaining bracket 106 may be inserted into various bores 105a in the basic body 105. Furthermore, the retaining bracket 106 is forced in the direction of the center of the sole of the boot by a spring (not shown). Furthermore, the basic body 105 is provided with transverse bores 105b for the insertion of pins (not shown) which delimit the pivoting of the retaining bracket 106.

Figure 2:
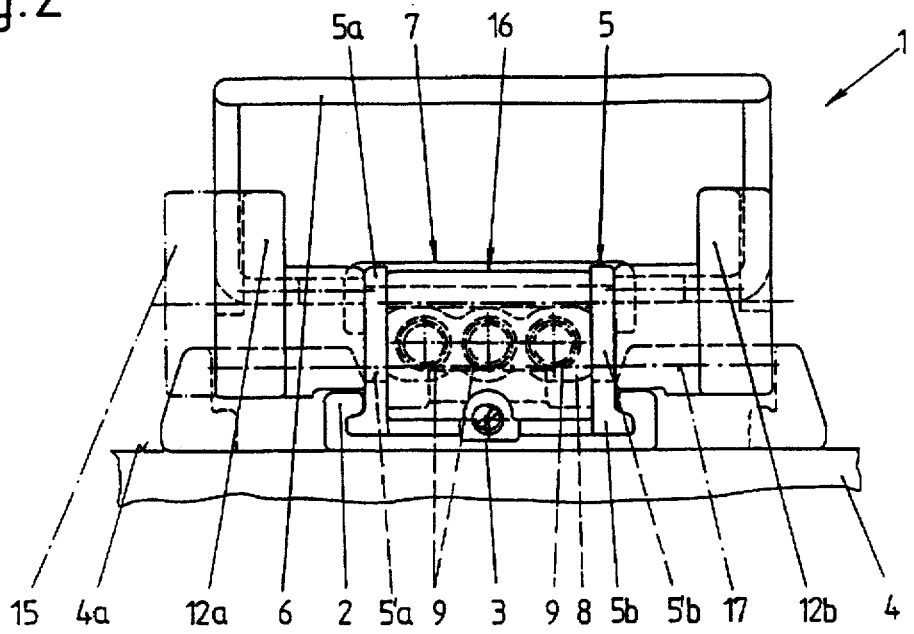
FIG. 2 shows a rear view of the snowboard binding according to the invention, likewise in the closed position.

An actuating element 11 is pivotably articulated on the base member 5 of the heel part 1, on the section remote from the center of the sole of the boot. The actuating element 11 has two upwardly projecting plates 12a and 12b which are located in the region of the outer sides of the boot 102 and are connected fixedly to one another by a locking piece 16 via the first pivot pin 14. As can be seen from FIG. 2, the two plates 12a, 12b are arranged outside the base member 5, whereas the locking piece 16 is arranged between side walls 5a, 5b of the base member 5. The retaining bracket 6 which engages over the rear sole border of the boot 102 is pivotably articulated on the plates 12a, 12b of the actuating element 11. For the purpose of opening the binding, at least one of the two plates 12a, 12b has an actuating extension 15. The retaining bracket 6 is forced in the direction of the center of the sole of the boot by a spring (not shown) and, in the open state is supported on two shoulders 13a, 13b which are arranged on the plates 12a, 12b of the actuating element 11. A locking member 16 is arranged between the plates 12a, 12b and is connected by a pin 17, whereby the latter is guided in two circular slotted holes 5'a, 5'b constructed in the sidewalls 5a, 5b of the base member 5, and limits the pivoting movement of the actuating element 11 in upward and downward directions. Furthermore a step-on element 7 is pivotally hinged about a second pin 19 on the base member 5 and loads or act on in the open state of the snowboard binding two projections 13c, 13d arranged on the plates 12a, 12b of the actuating element 11. A delimiting pin 17 is fitted on the plates 12a, 12b and through a locking piece 16, which pin 17 is guided in two slots 5'a, 5'b which are in the form of arcs of a circle in the side walls 5a, 5b of the base member 5 and delimits the pivot movement of the actuating element 11 to its top and bottom extent.

Furthermore, a locking slide 8 is arranged in a longitudinally, displaceable manner in the base member 5. The locking slide 8 is acted upon by a spring 9, which is supported on a wall 5c which faces the center of the sole of the boot and belongs to the base member 5. On the side facing the locking piece, the locking slide 8 is provided with a control surface 8a, 8b which has two straight pieces 8a, 8b which—as seen in the plane of the drawing—intersect at a salient point 8c and enclose an angle with one another, an obtuse angle $\alpha$ in the present exemplary embodiment. The locking slide 8 is in contact, via its control surface 8a, 8b, with a control surface 16a, 16b of the locking piece 16, various sections of the two control surfaces being in operative connection with one another in the individual phases during insertion and removal of the boot. The control surface 16a, 16b of the locking piece 16 likewise comprises two straight sections 16a, 16b which—as seen in the plane of the drawing—intersect at a salient point 16c and enclose an angle with one another, an obtuse angle $\beta$ in the present exemplary embodiment, the upper section 16a exhibiting a rounded extension 16d.

Figure 4:
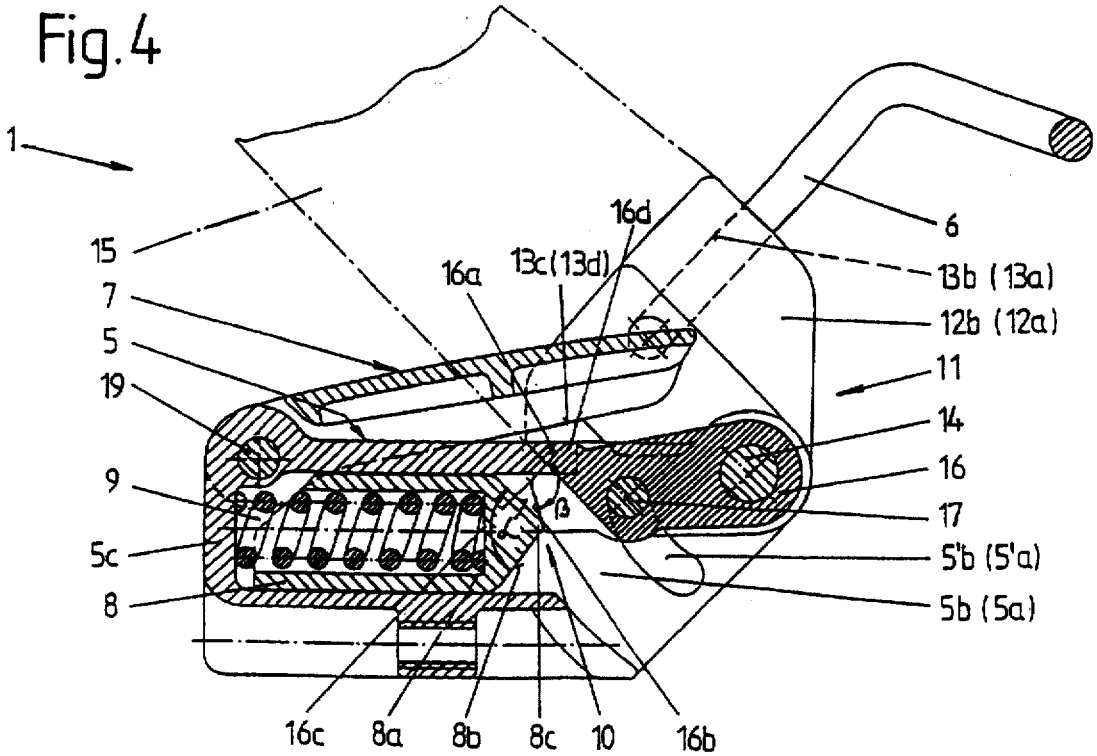

When the snowboard binding is in the open state (cf. FIG. 4), the step-on element 7 bears, over its full surface area, on the protrusions 13c, 13d of the plates of the actuating element 11. In this position, the locking slide 8 presses, with its salient point 8c, on the section 16b of the control surface 16a, 16b of the locking piece 16. Consequently, the actuating element 11 and, via the protrusions arranged on the plates 12a, 12b, the retaining bracket 6 articulated thereon are pivoted away from the center of the sole of the boot until the delimiting pin 17 and the associated slots 5'a, 5'b, in the form of arcs of a circle, delimit this pivoting movement.

Figure 5:
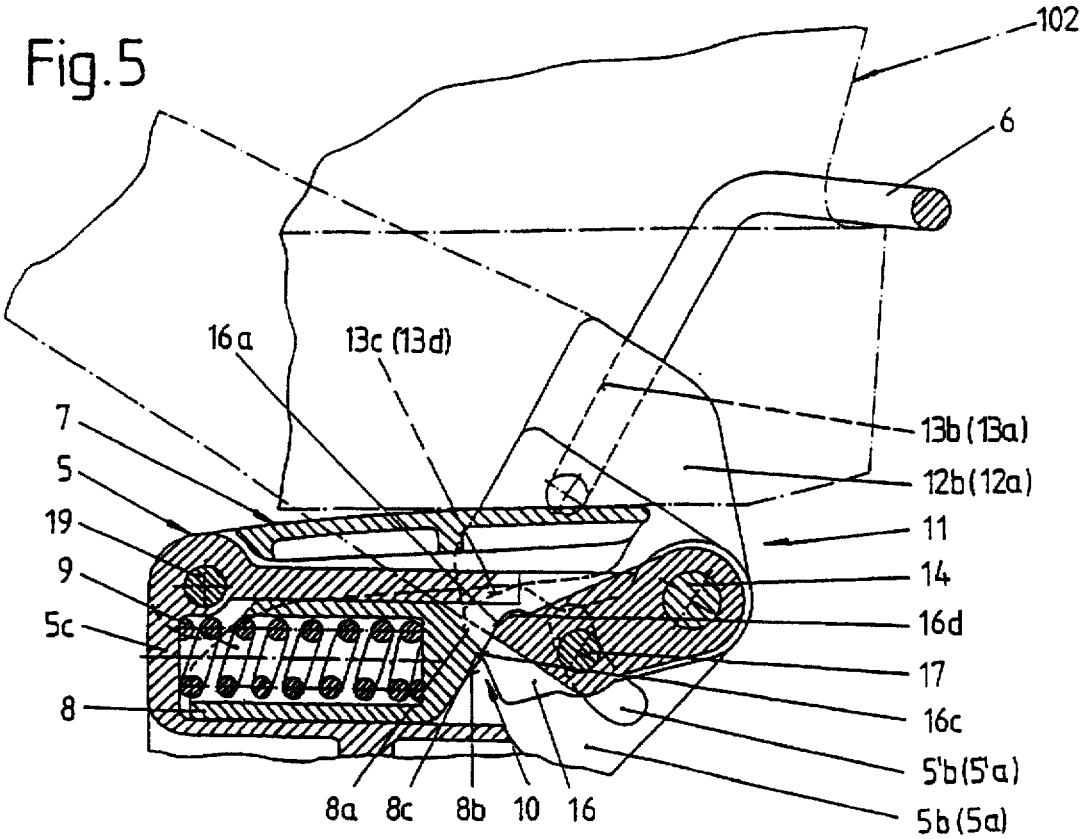

When a boot 102 is placed onto the step-on element 7, the latter presses, with its underside, on the protrusions 13c, 13d of the two plates 12a, 12b and pivots the actuating element 11 in the direction of the upper side of the snowboard 4a. In this arrangement, the locking slide 8 is displaced rearwards, counter to the force of the spring 9, while the locking piece 16 slides, with the lower section 16b of its control surface 16a, 16b, along the salient point 8c of the locking slide 8 until the dead center of the locking system 10 has been reached (cf. FIG. 5).

Figure 3:
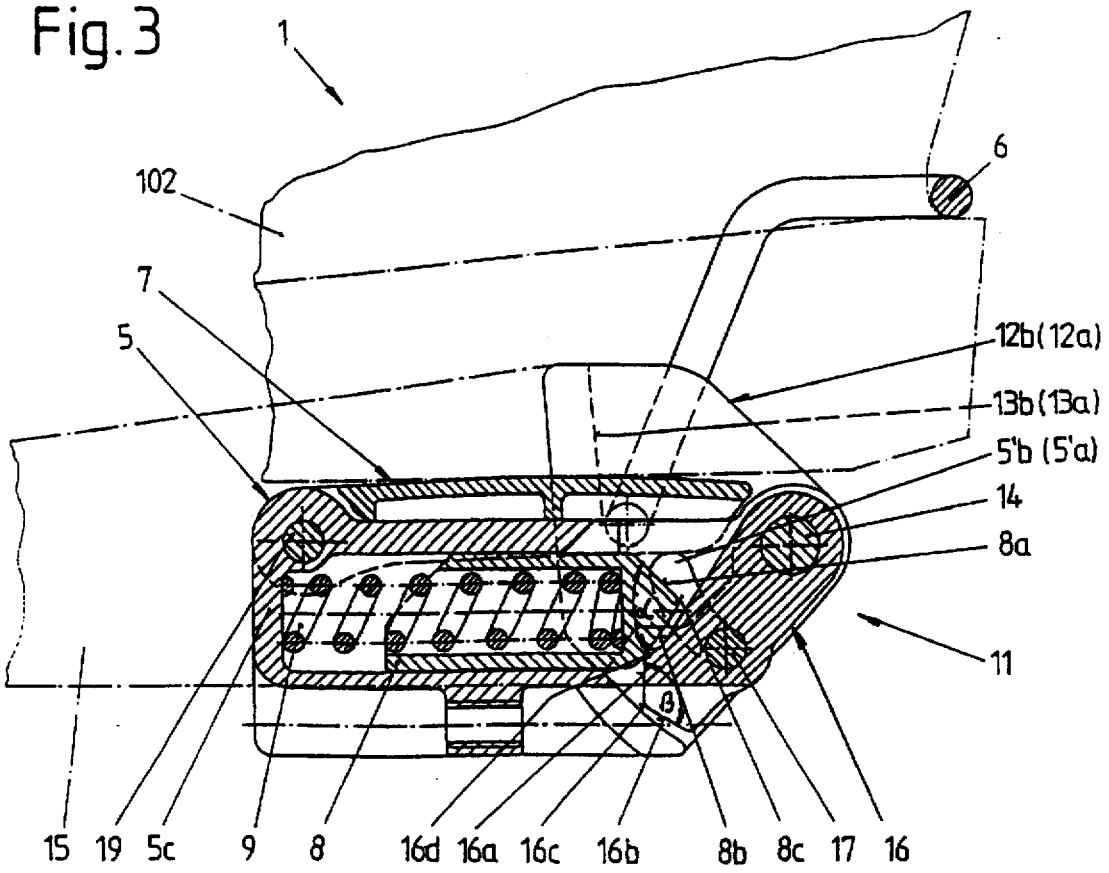
FIG. 3 shows the heel part as in FIG. 1, but on an enlarged scale.

Once the dead center position of the locking system 10 has been overcome, by pressing the step-on element further downwards, the step-on element 7 is disengaged from the plates 12a, 12b. The control surface 16a, 16b and the extension 16d of the locking piece 16 are acted upon by the control surface 8a, 8b of the locking slide 8, and the actuating element 11 is pivoted further in the direction of the upper side of the snowboard 4a, the retaining bracket 6 engaging over the rear sole border and thus retaining the boot 102 in the binding. In the case of a clean standard snowboard-boot sole, the locking slide 8 presses the actuating element 11 in the direction of the upper side of the snowboard 4a until the delimiting pin 17 assumes its bottom stop position in the slots 5'a, 5'b, of the two side walls 5a, 5b. The snowboard binding is now located in the maximum retaining position (cf. FIGS. 1 and 3).

Figure 6:
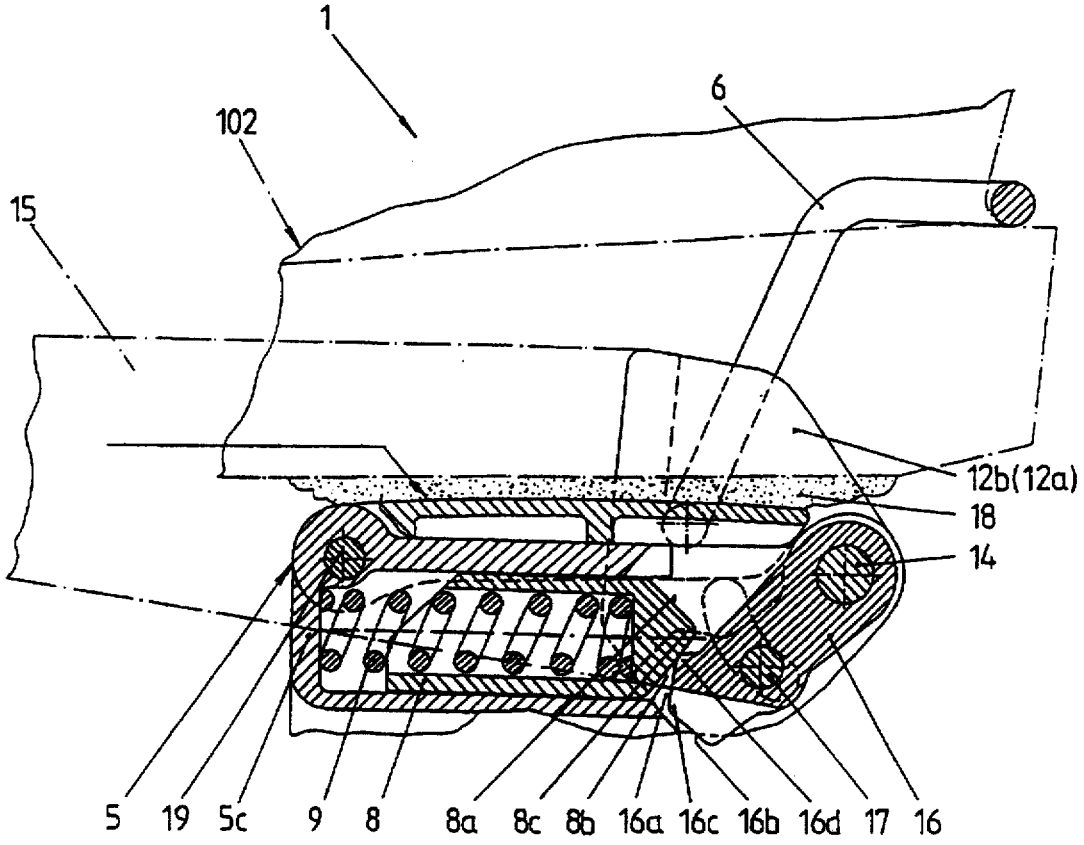

FIG. 6 shows a snowboard binding according to the invention with the boot 102 inserted, said boot having a layer of snow 18 beneath the sole of the boot. In this arrangement, it is no longer possible for the actuating element 11 to pivot downwards into the maximum retaining position, and the locking side 8 moves the locking piece 16 into a position Corresponding to the layer of snow 18 which is to be compensated for.

In order to open the snowboard binding, the actuating extension 15 is pivoted away from the upper side of the snowboard 4a until the locking slide 8 and the locking piece 16 have overcome the dead center position. The binding reaches the (open) state shown in FIG. 4 and is thus ready for the boot to be inserted once again.

The invention is not restricted to the exemplary embodiment represented in the drawing and described above. On the contrary, various modifications of said exemplary embodiment are possible without leaving the scope of the invention. For example, the embodiment in which the boot-insertion mechanism is assigned to the region of the toes of the user should also come under the protection of the invention. The inclinations of the control surfaces of locking slide and locking piece may also differ from the form which has been represented and described, as a result of which the boot-insertion force to be overcome and the retaining force may be chosen freely by the designer. Furthermore, an embodiment in which a soft binding can be inserted via a sole plate formed by the soft binding itself or in which a sole plate which can be connected to the soft binding by known means can be inserted into the binding according to the invention should also come under the protection of the invention, without leaving the scope of protection.

We claim:

1. In a snowboard binding having a base plate adapted to be securely attached onto a snowboard, and two retaining brackets which are connected to the base plate, the two retaining brackets each being pivotal about a pin extending transversely with respect to said base plate and which, when the binding is performing a retaining function, respectively engage over front and rear sole borders of a boot located on the base plate, and a releasable locking mechanism which retains the retaining brackets in a pivoted position engaged over the sole border to secure the boot, when the binding is performing the retaining function, to the base plate, one of the retaining brackets being articulated on an actuating element pivotally mounted on the base plate about a first pivot pin extending transversely with respect to said base plate, the improvement wherein a step-on element is provided and is articulatable relative to the base plate, wherein the actuating element is acted upon by an operative engagement with the step-on element, the step-on element being pivotally supported for movement about a second pin extending transversely with respect to said base plate, the step-on element being substantially positioned beneath the boot and operatively engaging the actuating element during a boot-insertion phase, and wherein at least one locking slide is provided and arranged on the base plate and supported for longitudinal movement, the at least one locking slide being substantially positioned beneath the boot and operatively engaging the actuating element and, after overcoming a dead center position thereof, urging the actuating element and hence the one retaining bracket to secure the boot to the base plate.

2. The snowboard binding as claimed in claim 1, wherein the actuating element has two upwardly projecting, laterally spaced plates located in a region of outer sides of the boot, and a locking piece connecting the two projecting plates.

3. The snowboard binding as claimed in claim 2, wherein the step-on element is arranged between the two plates of the actuating element, and wherein at least one of the two plates of the actuating element has an actuating extension.

4. The snowboard binding as claimed in claim 3, wherein, as the boot is inserted, the step-on element operatively engages two inwardly oriented protrusions which are arranged on the plates.

5. The snowboard binding as claimed in claim 2, wherein an end section of the locking slide which faces the locking piece has a control surface formed from two essentially straight sub-sections which enclose an obtuse angle.

6. The snowboard binding as claimed in claim 2 wherein an end section of the locking piece which faces the locking slide has a control surface which is formed from two generally straight sub-sections, the two generally straight sub-sections enclose an obtuse angle ($\beta$).

7. The snowboard binding as claimed in claim 6, wherein an end section of the locking slide facing the locking piece has a control surface formed of two generally straight sub-sections which enclose an obtuse angle ($\alpha$), the two sub-sections of the locking slide defining a first point, wherein the two sub-sections of the locking piece define a second point, wherein the first point contacts a lower one of the two sub-sections of the locking piece when the binding is in an open position during the boot insertion phase, wherein the dead center position is defined by the first point contacting the second point when the boot is partially positioned into the releasable locking mechanism, and wherein one of the two sub-sections of the locking piece has an extension, the extension contacting a lower one of the two sub-sections of the locking slide when the boot is fully received into the releasable locking mechanism.

8. The snowboard binding as claimed in claim 7, wherein the locking piece is positioned beneath the boot when the retaining bracket is secured to the boot.

9. The snowboard binding as claimed in claim 1, wherein the second pin, on which the step-on element is articulated, is spaced from the first pivot pin toward one of the two retaining brackets adapted to engage over the front sole border of the boot.

10. The snowboard binding as claimed in claim 1, wherein the actuating element is movable between first and second positions and is delimited at each position through a delimiting pin and associated slots, the associated slots being in the form of arcs of a circle and are formed in side walls of the base member.

11. The snowboard binding as claimed in claim 1, wherein said base plate includes parts displaceable longitudinally on the base plate, the parts being adapted to receive the boot thereon, wherein the releasable locking mechanism retains the brackets in the pivoted position engaging the sole border to secure the boot to the parts of the base plate, wherein the actuating element is mounted on one of the parts, and wherein the at least one locking slide is positioned on the one part of the base plate.

12. The snowboard binding as claimed in claim 11, wherein one of the parts of the base plate includes a wall, the wall being spaced apart from the first pivot pin, wherein the locking slide is reciprocally supported on one of the parts of the base plate for movement between first and second positions, wherein a spring is provided under the step-on element with one end thereof abutting the wall and an opposite end thereof engaging the locking slide to continually urge the locking slide to the first position to additionally urge the actuating element and the retaining bracket thereon into a latched position securing the boot to the base plate.

13. The snowboard binding as claimed in claim 12, wherein the locking slide in both the first and second positions is spaced from the wall.

14. The snowboard binding as claimed in claim 1, wherein the locking slide is reciprocally supported on the base plate for movement between first and second positions, wherein an elastically-yieldable member is provided directly under the step-on element with one end thereof abutting the base plate and an opposite end thereof engaging the locking slide to continually urge the locking slide to the first position to additionally urge the actuating element and the retaining bracket thereon to a latched position securing the boot to the base plate.

15. The snowboard binding as claimed in claim 14, wherein the elastically-yieldable member is an elongate spring.

16. The snowboard binding as claimed in claim 15, wherein the base plate has a wall member upon which the one end of the spring abuts, and wherein the locking slide is spaced from the wall member in the first and second positions.

17. The snowboard binding as claimed in claim 1, wherein the releasable locking mechanism is oriented substantially beneath the boot when the one retaining bracket is secured to the boot.

* * * * *